United States Patent [19]

Röck et al.

[11] 4,057,303

[45] Nov. 8, 1977

[54] DRAWER GUIDE

[75] Inventors: Erich Röck, Hochst; Bernhard Mages, Dornbirn, both of Austria

[73] Assignee: Julius Blum Gesellschaft mbH, Hochst, Austria

[21] Appl. No.: 688,482

[22] Filed: May 20, 1976

[30] Foreign Application Priority Data

May 23, 1975 Austria ..... 3950/75

[51] Int. Cl.[2] ..... F16C 29/02

[52] U.S. Cl. ..... 308/3.6

[58] Field of Search ..... 308/3.6, 3.8

[56] References Cited

U.S. PATENT DOCUMENTS

| | | | |
|---|---|---|---|
| 3,658,398 | 4/1972 | Abbate | 308/3.6 |
| 3,876,263 | 4/1975 | Oleksiak | 308/3.6 |
| 3,911,835 | 10/1975 | Schill | 308/3.6 |
| 3,923,347 | 12/1975 | Deav | 308/3.6 |

*Primary Examiner*—Richard A. Bertsch

[57] ABSTRACT

A drawer guide assembly employing a support rail with a guide rail assembly on each side of a drawer. The guide rail cooperates with rollers disposed on a carrier operable in cooperation with the guide rail assembly. An additional roller coacts with the carrier to provide favorable load characteristics for the drawer.

9 Claims, 2 Drawing Figures

DRAWER GUIDE

The invention relates to a drawer guide assembly for drawers or the like with one support rail on each side of the body structure e.g. a cabinet and one guide rail on each side of the drawer, with rollers transmitting the vertical forces between the support rails and the guide rails the rollers being carried in a floating roller carrier.

Drawer guide assemblies of this kind are known and used in modern furniture constructions and especially with kitchen furniture.

They facilitate the pulling out of the drawer, prevent clamping and, furthermore, offer a possibility of holding the drawer when partly pulled out of the cabinet.

Drawer guide assemblies of this kind are generally provided with rollers but also with skids preferably made of plastic or with a combination of rollers and gliding devices as well as freely movable balls.

It is the object of the present invention to provide a drawer guide assembly of the above-mentioned kind which allows a particularly smooth gliding and, furthermore, compared wit known drawer guide assemblies brings considerable savings of material. It is a further object of the invention to increase the load capacity of such a drawer guide assembly and to keep the amount of construction material low at the same time.

It has been considered that the load capacity of the drawer guide assembly can be increased by using stronger rollers. It has, however, turned out that the coating of the support flanges of the support rails and the guide rails is damaged when a certain load is exceeded.

According to the object of the invention at least one additional roller is provided in tandem arrangement to one or more of the carrier rollers.

In order to achieve a high load capacity of the assembly a preferred embodiment provides that the rollers and the additional rollers have a massive structure and a recess on one or on both sides of the hub in which a peg of the roller carrier engages.

This is of special importance in the case of plastic rollers.

In order to achieve a smooth engaging of the nose resp. stop, when the drawer is pulled out, it is further provided that at lest one of the supporting rollers, particularly the back one, that is placed near the stop and an adjacent additional roller are carried with vertical play in the roller support.

If the nose is placed above the recess e.g. a punch hole an if the guide rail is pulled out of the roller carrier and the support rail, the nose can rest in the opening in the carrier flange.

The following is a description of an embodiment of the invention accompanied by drawings.

Figure 1:
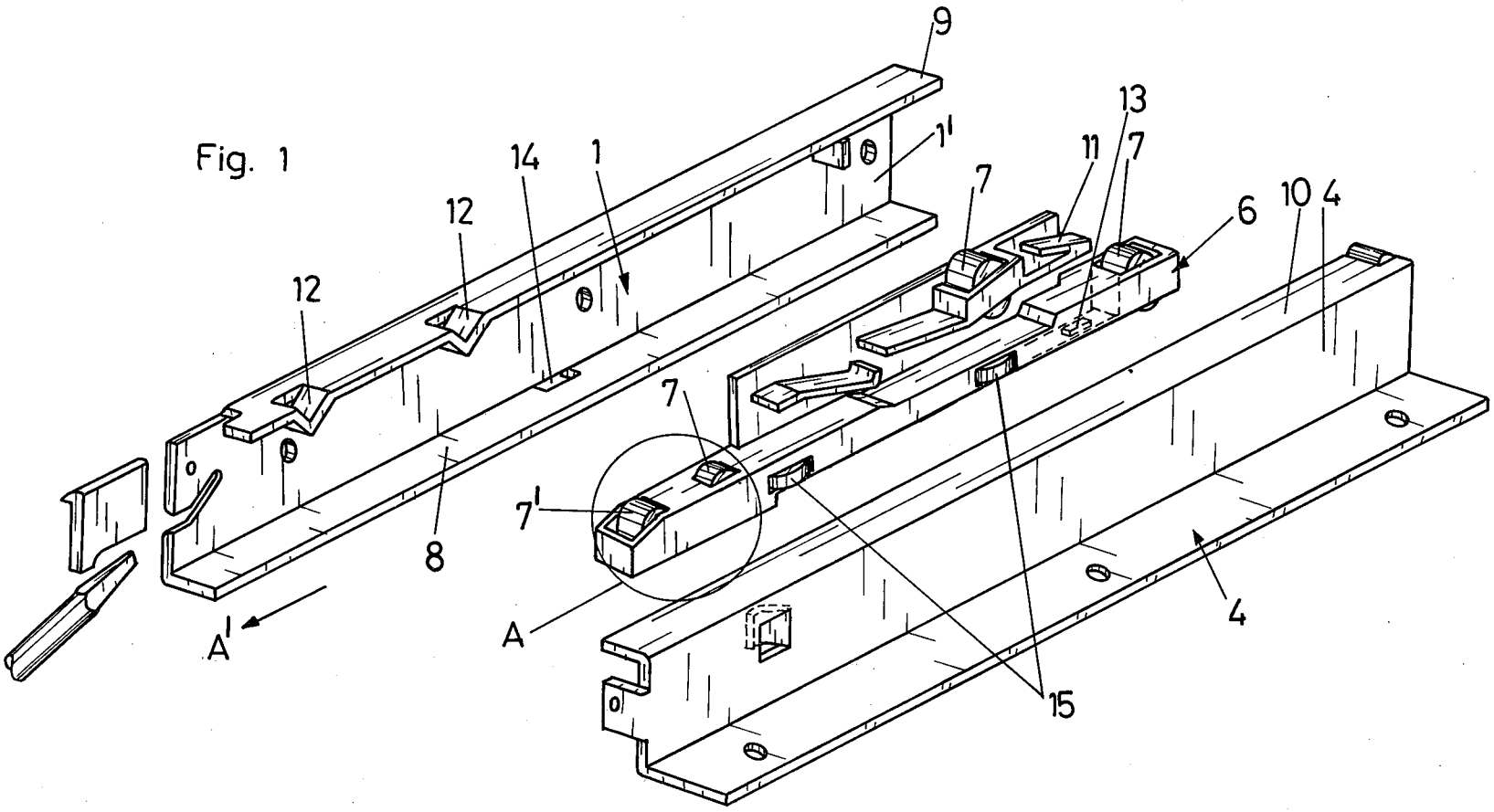
Figure 2:
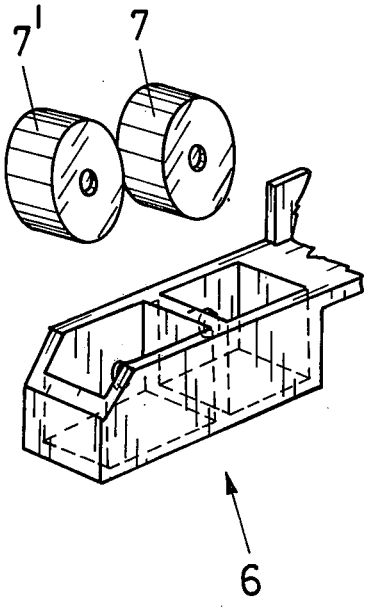

FIG. 1 is a schematic view of the drawer guide assembly according to the invention and FIG. 2 shows section A of FIG. 1.

The drawer guide assembly according to the invention consists of a support rail 1, mounted on the side-wall of the cabinet, the support rail 1 has a U-profile and can be inserted in a groove in the cabinet side-wall and of a guide rail 4 mounted on the side of the drawer.

In the embodiment shown the guide rail 4 on the side of the drawer has a Z-profile so that when mounted the side-wall of the drawer rests on a flange of the guide rail 4.

The guide rail can, of course, also be L-profile shaped.

As be seen in FIG. 1 of the drawing a floating roller carrier 6 is placed in the U-profile of the rail 1. The roller carrier 6 is preferably of plastic material and injection molded. Three rollers 7 are disposed in the roller carrier 6 in such a way that two rollers 7 roll on the support flange 8 of the support rail 1 whereas the third roller 7 is positioned near the upper horizontal flange 9 of the support rail 1.

In order to increase the load capacity of the drawer guide assembly an additional roller 7' in tandem arrangement adjacent to the front roller 7.

When required, one or more additional rollers 7' can be mounted. The additional rollers 7' can equally be coordinated with one or both rollers 7 so that there results a large adaptability to the load of the drawer. If the drawer is closed the flange 10 of the guide rail 4 is pulled into the roller carrier 6 in such a way that the flange 10 is supported by the two lower rollers 7 and by the additional roller 7', whereas the third and with regard to the depth of the piece of furniture middle roller 7 lies on top of the flange 10.

In this stage the guide rail 4 together with the drawer are held in the support rail 1 and are secured against tilting.

If the drawer and consequently the guide rail 4 are pulled out from the cabinet in the direction of the arrow A' the freely running roller carrier 6 also is in motion.

In its front section the flap 11 which is moulded in one piece with the roller carrier 6 lies underneath a stop 12 of the support rail 1.

The stop 12 is formed on the free end of the upper horizontal flange 9 of the support rail 1 and at the same time is a side-support for the roller carrier 6 when the drawer is pulled out of the drawer guide assembly.

According to the invention two stops 12 can be provided.

If the drawer is completely pulled out of the drawer guide assembly the flap 11 presses the roller carrier 6 downwards so that the nose 13 forming the stop is pressed into the recess 14 of the flange 8.

In this position the roller carrier 6 remains secured in the support rail 1 without the side support of the drawer.

In order to achieve extremely smooth gliding balancing rollers 15 are provided which turn around an imaginary axis that is at right angle to the imaginary axis of the rollers 7. Th construction and bearing of the balancing rollers 15 correspond to the rollers 7 and the additional roller 7'.

The balancing rollers 15 thereby move on the vertical flange 1' of the support rail 1 and on the vertical flange 4' of the guide rail 4.

We claim:

1. A drawer guide assembly for a drawer positionable in a structure employing support rail means disposed on each side of said structure in cooperative working relation with guide rail means positioned on each side of the drawer, said quide assembly including: roller means carried in a floating roller carrier means being operable with respect to the said guide assembly, said roller carrier means having additional roller means co-acting with said guide assembly and in tandem arrangement to said roller means to thereby increase the load characteristics of said drawer.

2. A drawer guide assembly according to claim 1, wherein: said roller carrier means is engageable with upper and lower elements defining said guide assembly and being provided with stop means which engages recess means in said lower element of said guide assembly when the drawer is pulled out, thereby simultaneously restraining said roller carrier means from unwanted movement.

3. A drawer guide assembly according to claim 2, wherein: said stop means is a nose.

4. A drawer guide assembly according to claim 2, wherein: said recess means is a punched hole.

5. A drawer guide assembly according to claim 2 wherein: spring element means being disposed on the roller carrier means opposite said stop means at a point corresponding to a second stop means of said guide assembly.

6. A drawer guide assembly according to claim 5, wherein said spring element means is defined by a spring flap.

7. A drawer guide assembly according to claim 5 wherein: said spring element means and said roller carrier means are formed of one piece by injection molding.

8. A drawer guide assembly according to claim 1, wherein: roller means and said additional roller means being in tandem arrangement with respect to one another and have a recess on at least one side of a hub for engagement with engagement means of said roller carrier means.

9. A drawer guide assembly according to claim 8 wherein: clearance is provided between said recess means and said engagement means to enable at least one roller of said roller means and one roller of said additional roller means in tandem relationship with one another, to co-act in the presence of a vertical clearance.

* * * * *